US005209442A

United States Patent [19]

Buck et al.

[11] Patent Number: 5,209,442

[45] Date of Patent: May 11, 1993

[54] GRIPPER

[76] Inventors: Hugh E. Buck, Box 063, Ferrysburg, Mich. 49409; John Buck, deceased, late of Columbus; by Dorothy I. Buck, executor, 4757 Stiles Ave., Columbus, both of Ohio 43228

[21] Appl. No.: 902,873

[22] Filed: Jun. 23, 1992

[51] Int. Cl.[5] ..... B65B 67/04

[52] U.S. Cl. ..... 248/99; 220/404; 220/908; 248/97

[58] Field of Search ..... 248/100, 101, 95, 97, 248/99; 220/404, 908; 141/391, 314

[56] References Cited

U.S. PATENT DOCUMENTS 4,157,801 6/1979 Elmer ..... 248/101 X
4,548,372 10/1985 Lutzker ..... 248/99
4,576,310 3/1986 Isgar ..... 220/404
4,735,340 4/1988 Preston ..... 248/100 X
4,763,808 8/1988 Guhl ..... 248/100 X
4,765,579 8/1988 Robbins ..... 248/101
4,923,087 5/1990 Burrows ..... 220/908 X
5,088,667 2/1992 Olson ..... 248/101

*Primary Examiner*—J. Franklin Foss
*Attorney, Agent, or Firm*—Price, Heneveld, Cooper, DeWitt & Litton

[57] ABSTRACT

A gripper having an elongated first member which has a pair of spaced walls which form a locking channel into which a second member having a projecting tubular locking portion can push a layer of flexible material. The flexible material and the tubular locking portion are releasably held by the locking channel on the first member. A layer of adhesive material is on the back of the first member for attaching the first member to a surface. A keeper is provided for connecting the first and second members when not in use.

7 Claims, 1 Drawing Sheet

GRIPPER

BACKGROUND OF THE INVENTION

It is common practice today to line waste baskets, trash cans and other containers with plastic bags to contain the garbage or trash and to protect the container from contact with the refuse material. The plastic bag used as a liner for the container is usually oversized in order to enable the person installing the bag to have room to tie a knot for fastening the bag about the edge of the container. Besides being an unnecessary expense in having to use oversized bags, the excess material tends to block the free passage of the trash or refuse into the trash can liner. It is a common occurrence to have heavy materials, such as food waste, pull the liner away from one side of the container. Additional trash and food waste can then fall onto the loosened liner, pushing the liner further into the container and also fall outside of the liner directly into the container, thus defeating the purpose of using a trash can liner. This problem is particularly sensitive in medical and industrial applications where it is of utmost importance to maintain the sterility and cleanliness of the environment.

Attempts have been made to solve slippage of the trash can liner by using bungie cords or bands strapped about the liner and the container. While this does help to solve the problem, it creates a second problem; in order for the cord or band to properly hold the trash can liner, it must be tightly stretched about the container. This presents a potential for serious injury when the bungie cord or band is released to remove the trash can liner. Attempts have also been made to use clips to hold the edge of the trash can liner; however, these have been found to be only marginally suitable on straight edged containers where the clip can grip the maximum amount of the trash can liner. On rounded containers the clip would only tend to grip at spaced extreme points on the clip edge. The bungie cord and clip also presented an additional problem in that both were separate pieces that could become lost, misplaced, or accidentally thrown out with the trash.

Another common problem arises in draining oil from an engine. The oil should be collected for recycling; however, each time the oil is changed a large container is lost to the oil collection location. It would be convenient if this oil could be collected in a plastic container liner and then delivered to the collection location in the plastic bag.

Paint, plaster, chemicals, etc., all present problems in that the container used is lost once it is contaminated with the material, regardless of how large or small an amount is placed in a container. Here again, if the container had a disposable liner, the container in which the residue is contained could be reused many times.

SUMMARY OF THE INVENTION

In accordance with the present invention, a gripper is provided for the flexible material of the container liner. When the gripper is used, the liners can be of the proper size for the particular container, thus reducing the unnecessary costs of the larger bags needed to provide material for a knot. A pair of grippers can be attached to opposite sides of a container near the open top and can receive and hold the trash can liner. A keeper is provided for maintaining two pieces of the gripper on the side of the container when not in use.

The gripper can be used to hold a liner on any size or shape container protecting the container from contamination and enabling it to be reused for the same or different materials. In medical and industrial applications, the grippers will protect the container from contamination, thereby helping to maintain a sterile environment.

The plastic film gripper includes a base strip having a first and a second side. An adhesive material is on the first side of the gripper for attaching the base strip to a surface. An elongated locking channel is on the second side of the base strip. A tie strip having an elongated projecting portion is configured to fit within and be held by the locking channel on the base strip. A keeper is provided for attaching the tie strip to the base strip so that the tie strip will not become misplaced when not in use.

DETAILED DESCRIPTION OF THE PREFERRED EMBODIMENTS

Figure 2:
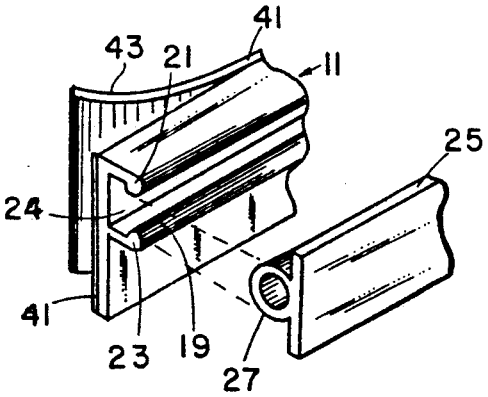
FIG. 2 is an enlarged, fragmentary, perspective view showing the tie strip in line with the locking channel on the base strip.
Figure 1:
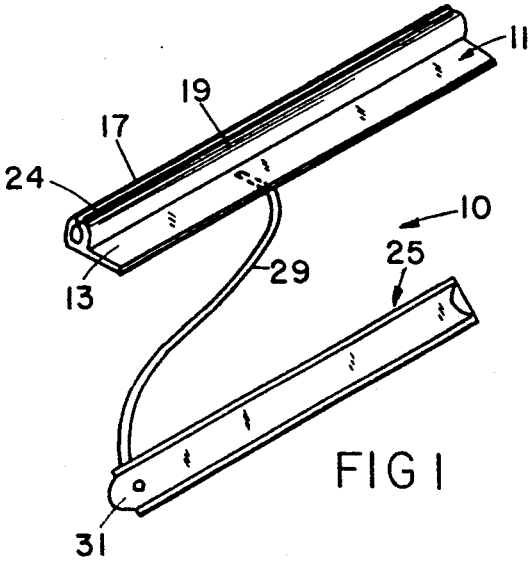
FIG. 1 is a perspective view of the gripper.

Referring to FIG. 1, the illustrated gripper 10 has a base strip member 1 1 which has an elongated, flat surface 13 upon which are mounted a pair of upstanding walls 17 and 19. Each wall has an inwardly curved distal edge 21 and 23 (FIG. 2), respectively. Walls 17 and 19, and opposed distal edges 21 and 23, form a locking channel 24 on the surface of base strip member 11. Walls 17 and 19 can be curved inwardly toward each other, as shown in FIG. 1, or can be substantially straight, as shown in FIG. 2. Distal edges 21 and 23 are substantially rounded to provide a smooth entrance to the locking channel.

Referring to FIG. 2, a tie strip 25 has an elongated, substantially tubular projecting portion 27 on one side thereof. The tubular portion is adapted to fit within the locking channel 24 on base member 11 and to be held in place within the locking channel.

Figure 3:
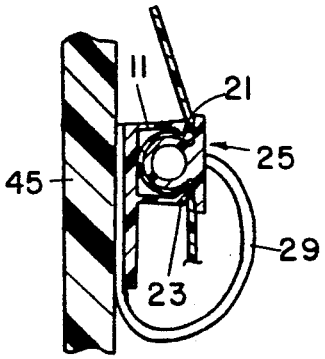
FIG. 3 is a side elevational view of a plastic film being held by the gripper.

Referring to FIG. 3, a keeper 29 is attached at one end 31 to base member 25 and is adapted to be held beneath base member 11. Keeper 29 functions as a tether to keep the tie strip 25 from becoming lost or misplaced when not in use and held in place in the locking channel.

Figure 4:
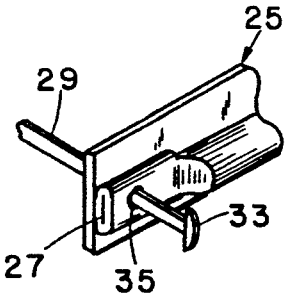
FIG. 4 an enlarged, fragmentary, perspective view showing the keeper in the end of a tie strip.

The end of keeper 29 can be attached to tie strip 5 by a molding, bonding, welding process or, as shown in FIG. 4, a knot 33 or a deformation of the plastic material can be formed at one end of the keeper which is then incapable of passing through a hole 35 which extends through two flattened surfaces of channel 27 and the base of tie strip 25. Using the knot or fused piece on the end of keeper 29, enables the keeper to move more freely relative to base strip 11.

Base strip 11 and tie strip 25 are both preferably made of an organic polymeric material. Any of the well-known plastic materials can be used; however, high density polyethylene is preferred in view of its relative chemical inertness, low cost and easy workability. Both the base member and tie strip can be made by molding or extrusion techniques with long lengths of materials being prepared and then cut into usable lengths. In the preferred embodiment of the gripper, each of the pieces is approximately four inches long. The base strip member is more rigid than the tie strip member since base 13 is thicker than the base of the tie strip member. Base 13 is made thicker so as not to deform under the pull of the film material held in locking channel 24. The tie strip member exhibits a degree of flexibility to enable it to bend as it is being pushed into locking channel 24 in base member 11, and also to bend as it is being stripped out of the locking channel.

Keeper or tether 29 is a thin strip of flexible plastic material approximately four inches in length and one-eighth inch in width, similar to the commonly available plastic lacing material. A layer of adhesive material 41 (FIG. 2) is applied to the back of base strip member 11 The adhesive material can be a layer of tacky glue or a single or double sticky tape material, which is attached to the back of the base. A release paper 43 is used to cover the adhesive material until it is ready to be applied to a surface.

In using the film gripping material, and referring to FIG. 3, base member 11 is attached to a surface, for example, a container 45 by means of adhesive 41. Keeper 29 is preferably centered under the base strip member so that the tie strip member can be used either left-to-right or right-to-left. A sheet of plastic material would be stretched over the face of locking channel 24 formed between walls 17 and 19 and would then be pressed into the channel by tubular protrusion 27 which extends the length of tie strip 25. When in place, the plastic material is tightly held by edges 21 and 23 and is pushed slightly behind the rear edge of tubular member 27. Rounded edges 21 and 23, as previously described, facilitate entry of the plastic material into the locking channel without danger that the plastic material might be torn by a sharp edge. The plastic material will now be tightly held by the film gripper until either end of tie strip 25 is gripped by the fingers and then pealed outwardly from the locking channel.

Figure 5:
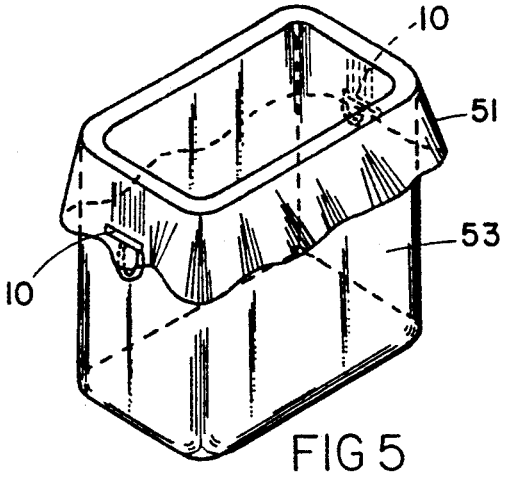
FIG. 5 a schematic view showing a gripper on each end of a container with straight sides, a plastic bag being held by the gripper.

Now referring to FIG. 5, a plastic bag 51 is shown in place in a container 53 with the edge of the bag turned over the edge of the container. A gripper 10 is attached to the surface of container 53 at each end approximately two inches down from the edge of the container. The plastic film material forming the bag is then placed over locking channel 24 in base strip member 11 and is pushed into the locking channel and held in place by tie strip 25 The plastic bag will be tightly held and prevented from pulling away from the walls of the container until the tie strip is removed from the locking channel and the plastic bag is released.

Figure 6:
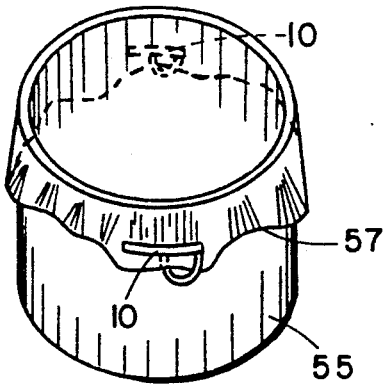
FIG. 6 a perspective view, similar to FIG. 5, showing grippers on the side of a round container holding a plastic bag.

As shown in FIG. 6, two grippers 10 are attached to the outer walls of a round container 55 and a plastic bag 57 is turned outwardly over the edge of the round container. As mentioned previously, base strip member 11 is relatively stiff due to the thickness of base portion 13. In order to attach the base member to a round surface, the base member should be given a preliminary bend to conform to the outer shape of the round container. Release paper 43 can then be withdrawn from the base member. Referring to FIG. 1, position the end of keeper 29 under the center of base strip 1, then the base member can be attached to the surface of the container approximately two inches below the upper edge of the container. In mounting the base member, it is preferred to position it, as shown in FIG. 2, with the channel at the upper portion of the base. By putting the channel in this location, the channel can flex slightly while not applying a lever or pulling action to the lower edge of the base strip member.

While the gripper has been described and explained in use holding a trash can or receptacle liner, it also can be used with flat film surfaces such as table, boat and machinery covers. The gripper can also be sized to meet the particular conditions, commercial or domestic, in which it is to be used. For example, when used as a boat cover, it can be sized substantially larger than that used for a trash can liner. The particular size needed can easily be determined by experimentation.

From the above description it can be seen that a simple reliable device is provided for holding film materials in place.

Although the invention has been described with respect to specific preferred embodiments thereof, many variations and modifications will become apparent to those skilled in the art. It is, therefore, the intention that the appended claims be interpreted as broadly as possible in view of the prior art to include all such variations and modifications.

The embodiments of the invention in which an exclusive property or privilege is claimed are defined as follows:

1. A gripper for holding a plastic trash bag in place in a receptacle so that the trash bag can cover and protect the edge about the opening in a receptacle and the interior of the receptacle from contamination by refuse being placed in the receptacle comprising:

an elongated first member having a first and a second side, a pair of spaced, substantially parallel upstanding walls forming a locking channel extending the full width of said first member;

a layer of adhesive material on said second side of said first member for attaching said said first member to the outside of a receptacle at a position spaced from an opening in a receptacle;

an elongated second member having an elongated locking portion for insertion into said locking channel on said first member for holding a portion of a plastic trash bag between said first and second members enabling a plastic bag to extend upwardly from a position where said first member is attached to the outside of a receptacle over the edge bounding the opening in the receptacle and down into the receptacle.

2. A gripper for holding a plastic trash bag as set forth in claim 1, wherein said upstanding walls on said first member are bowed to grip the surface of said locking portion of said second member.

3. A gripper for holding a plastic trash bag as set forth in claim 1, including an elongated flexible keeper for connecting said first member and said second member when not locked together.

4. A gripper for holding a plastic trash bag as set forth in claim 1, wherein said elongated flexible keeper is attached to an end of said elongated second member.

5. A gripper for holding a plastic trash bag as set forth in claim 1, wherein said locking channel is off-center on said first side of said first member.

6. A gripper for holding a flexible material as set forth in claim 1, wherein said elongated locking portion on said second member is of a tubular configuration.

7. A gripper as set forth in claim 1, wherein said elongated second member can bend to facilitate entry and exit from said first member.

* * * * *

UNITED STATES PATENT AND TRADEMARK OFFICE

CERTIFICATE OF CORRECTION

PATENT NO. : 5,209,442
DATED : May 11, 1993
INVENTOR(S) : Hugh E. Buck

It is certified that error appears in the above-indentified patent and that said Letters Patent is hereby corrected as shown below:

Column 2, line 25: after "Fig. 4" insert --is--;

Column 2, line 30: after "Fig. 6" insert --is--;

Column 2, line 60: "tie strip 5" should be --tie strip 25--;

Column 3, line 53: after "strip 25" insert --.--;

Column 3, line 66: "base strip 1" should be --base strip 11--;

Column 4, claim 2, line 52: "of" should be --on--

Signed and Sealed this

Sixteenth Day of May, 1995

*Attest:*

Bruce Lehman

BRUCE LEHMAN

*Attesting Officer*

*Commissioner of Patents and Trademarks*